US008608068B2

(12) United States Patent
Carpenter

(10) Patent No.: US 8,608,068 B2
(45) Date of Patent: Dec. 17, 2013

(54) MAIL PROCESSING TRACKING SYSTEM AND METHOD

(75) Inventor: Michael D. Carpenter, Arlington, TX (US)

(73) Assignee: Siemens Industry, Inc., Alpharetta, GA (US)

( * ) Notice: Subject to any disclaimer, the term of this patent is extended or adjusted under 35 U.S.C. 154(b) by 312 days.

(21) Appl. No.: 12/315,843

(22) Filed: Dec. 5, 2008

(65) Prior Publication Data

US 2009/0145967 A1 Jun. 11, 2009

Related U.S. Application Data

(60) Provisional application No. 60/992,524, filed on Dec. 5, 2007.

(51) Int. Cl.
*G06F 19/00* (2011.01)

(52) U.S. Cl.
USPC ..... 235/385; 235/375; 705/14.24; 705/28; 705/29

(58) Field of Classification Search
CPC .. G06Q 10/0833; G06Q 15/083; G06F 17/00; G06F 17/03332; G06F 17/30; G06F 17/30879; G06F 17/30781
USPC ..... 235/380, 385, 375; 705/14.24, 22, 28, 705/29; 700/225, 236
See application file for complete search history.

(56) References Cited

U.S. PATENT DOCUMENTS 5,422,821 A 6/1995 Allen et al.
5,692,593 A 12/1997 Ueno et al.
5,708,423 A 1/1998 Ghaffari et al.

(Continued)

FOREIGN PATENT DOCUMENTS

| | | | |
|---|---|---|---|
| DE | 10037756 | C1 | 11/2001 |
| EP | 1515279 | A1 | 3/2005 |
| WO | WO 2004/030836 | A1 | 4/2004 |
| WO | WO 2006/012399 | A2 | 2/2006 |

OTHER PUBLICATIONS

Notice of Allowance dated Apr. 29, 2011 in connection with U.S. Appl. No. 11/840,749.

(Continued)

*Primary Examiner* — Michael G Lee
*Assistant Examiner* — Tabitha Chedekel

(57) ABSTRACT

A method is described for tracking position of a mail piece within a facility. It includes steps of scanning a series of mail pieces to obtain identifying indicia therefrom, sorting the series of mail pieces according to a destination-based postal sorting strategy; and placing the sorted mail pieces into a container together with a marker comprising an RFID tag. In a computerized control system, identifiers for the RFID marker are identified with a sequence of mail pieces in the container. The RFID tag is scanned to associate a position of the container at the time of scanning with the mail in the container. The container is then transported, e.g. by loading a tray as the container onto a cart and then moving the cart. The method further includes video tracking the container from the position at the time of scanning to a later, different position at which a further postal operation takes place, such as loading of the trays onto a truck or feeding the mail from the trays onto the feeding ledge of a sorting machine hen a subsequent sorting step is needed.

9 Claims, 3 Drawing Sheets

(56) References Cited

U.S. PATENT DOCUMENTS

| | | | | |
|---|---|---|---|---|
| 5,777,884 | A | 7/1998 | Belka et al. | |
| 5,909,796 | A | 6/1999 | Soldavini | |
| 5,920,261 | A | 7/1999 | Hughes et al. | |
| 5,973,732 | A | 10/1999 | Guthrie | |
| 6,105,751 | A | 8/2000 | Jentjens et al. | |
| 6,239,397 | B1 | 5/2001 | Rosenbaum et al. | |
| 6,467,606 | B1 | 10/2002 | Elent et al. | |
| 6,480,108 | B2 | 11/2002 | McDonald | |
| 6,499,582 | B1 | 12/2002 | Gillott | |
| 6,801,833 | B2 | 10/2004 | Pintsov et al. | |
| 6,804,578 | B1 | 10/2004 | Ghaffari | |
| 6,822,182 | B2 | 11/2004 | Kechel | |
| 7,090,134 | B2 | 8/2006 | Ramsager | |
| 7,098,793 | B2 | 8/2006 | Chung | |
| 7,112,031 | B2 | 9/2006 | Harres et al. | |
| 7,123,149 | B2 | 10/2006 | Nowak et al. | |
| 7,180,420 | B2 | 2/2007 | Maurer | |
| 7,195,236 | B2 | 3/2007 | Hillerich, Jr. et al. | |
| 7,199,715 | B2 | 4/2007 | Fields et al. | |
| 7,232,066 | B2 | 6/2007 | Andreasson et al. | |
| 7,242,302 | B2 | 7/2007 | Rai et al. | |
| 7,309,000 | B2 * | 12/2007 | McDonald | 235/375 |
| 7,319,393 | B2 | 1/2008 | Forster | |
| 2003/0155283 | A1 | 8/2003 | Boensch | |
| 2004/0195320 | A1 * | 10/2004 | Ramsager | 235/385 |
| 2005/0077353 | A1 | 4/2005 | Oishi et al. | |
| 2005/0119786 | A1 * | 6/2005 | Kadaba | 700/224 |
| 2007/0226088 | A1 * | 9/2007 | Miles et al. | 705/28 |
| 2008/0111675 | A1 | 5/2008 | Tuttle | |
| 2008/0164185 | A1 | 7/2008 | Stemmle | |
| 2008/0230449 | A1 | 9/2008 | Stemmle | |

OTHER PUBLICATIONS

Office Action dated Oct. 26, 2010 in connection with U.S. Appl. No. 11/840,749.

Response to Office Action filed Jan. 24, 2011 in connection with U.S. Appl. No. 11/840,749.

Restriction Requirement dated Sep. 9, 2010 in connection with U.S. Appl. No. 11/840,749.

Response to Restriction Requirement filed Oct. 5, 2010 in connection with U.S. Appl. No. 11/840,749.

* cited by examiner

MAIL PROCESSING TRACKING SYSTEM AND METHOD

This application claims priority of U.S. Provisional Application No. 60/992,524 filed Dec. 5, 2007.

FIELD OF THE INVENTION

The invention relates to mail tracking systems for use in a postal sorting facility as currently operated by the U.S. Postal Service (USPS).

BACKGROUND OF THE INVENTION

Recently a number of proposals have been made to make use of RFID (radiofrequency ID) tags to track mail in postal processing. In the conventional approach to RFID tracking in mail processing, mail is sorted on an automated mail sorting machine such as an DBCS or MLOCR machine in use by the U.S. Postal Service. Such mail is swept from pockets of the sorter into trays by postal employees. Each tray has an RFID tag. In practice, this approach is problematic. After first processing, the manifest of mail sorted to a specific pocket is broken, i.e, sweeping loses definite association between mail and tray, so it cannot be known which of several successive trays a specific mail piece was placed in. Operator correlation of tagged tray and the letters it contains is unreliable and highly labor intense.

In another known approach, each mail piece is tagged with its own RFID tag, but this requires too many tags to be cost effective, and when tags are too close together they become difficult to read, hence such a system is unreliable.

Placement of RFID tags on less than all mail pieces in order to identify them has been proposed. See, for example, Sadatoshi et al. U.S. Patent Pub. 20050077353, which allows multiple mail pieces in a tray to be read by RFID. Most RFID readers presently available specify 4 inches between tags because the tag in front relative to the reader shades the one behind it. The system of Sadatoshi et al. solves that problem, but it only works if the tray is moved parallel and in close proximity to the reader antenna with mail perpendicular to the plane of movement. This could be made to work in a tray management system where the trays are moved down conveyors, but would not be practical for a cart of mail in trays.

A better approach is described in commonly assigned Redford U.S. Ser. No. 11/840,749, filed Aug. 17, 2007, the contents of which are incorporated by reference herein. In that application, a process of tracking mail during postal handling includes an initial step of sorting an incoming stream of mail on an automated sorting machine to a series of pockets based on a sort scheme. During sorting, RFID-tagged, machine-sortable markers are introduced into the incoming mail stream at intervals and the RFID-tagged markers are sorted with the mail into pockets of the sorter. Mail and markers are swept from the pockets into trays, and the markers are introduced such that at least one marker is swept to each of a set of trays containing the sorted mail. The trays containing the mail and markers are then transported away from the automated sorting machine. During a postal operation subsequent to the initial sorting, one or more of the RFID-tagged markers are scanned to identify mail from the initial sorting. As described, this method preferably utilizes RFID gateways through which carts carrying tagged mail trays must pass in order to move from one location within the postal facility to another. However these gateways require considerable cost to deploy, and thus it is a goal of the present invention to reduce the number of gateways needed for an RFID system such as the Redford '749 system. In addition, a gate-based system cannot identify where a specific tray is within an area that is between two RFID gates. In other words, the system can tell where a tray isn't, but not where it is, except at the moment it is passing through a gate. The present invention seeks to improve on these results.

A vision system was proposed for use in a parcel handling facility for the purpose of projecting handling instructions on or near a parcel on a conveyor. See Ramsager U.S. Pat. No. 7,090,134 describes a system for projecting a handling instruction onto a moving item or parcel. See also commonly assigned U.S. Ser. No. 12/266,779 filed Nov. 7 2008, the contents of which are incorporated by reference herein.

SUMMARY OF THE INVENTION

A method for tracking position of a mail piece within a facility includes the steps of scanning a series of mail pieces to obtain identifying indicia therefrom, sorting the series of mail pieces according to a destination-based postal sorting strategy; and placing the sorted mail pieces into a container together with a marker comprising an RFID tag. In a computerized control system, identifiers for the RFID marker are identified with a sequence of mail pieces in the container. This could be a list entered by the operator, but is preferably a list generated by the control system by keeping track of the sorting results.

The RFID tag is scanned to associate a position of the container at the time of scanning with the mail in the container. The container is then transported, e.g. by loading a tray as the container onto a cart and then moving the cart. The method further includes video tracking the container from the position at the time of scanning to a later, different position at which a further postal operation takes place, such as loading of the trays onto a truck or feeding the mail from the trays onto the feeding ledge of a sorting machine hen a subsequent sorting step is needed.

According to one embodiment of the invention it is assumed that the interior space of a postal facility is divided into zones, and that it is necessary for a cart or postal vehicle carrying mail trays to pass through a gateway to get from one zone to another. A zone or "tracking zone" is an area of a facility which has at least one RFID detection gateway through which a cart or container with one or more RFID tags must pass in order to enter or leave (either or both). Most intermediate zones will have at least two gateways, an entrance and an exit. Except at the gateways, the zone is preferably physically enclosed so that it is not possible for a cart or vehicle carrying trays to enter or leave other than through one of the gateways. This is useful but not critical, since the visual tracking system can sound an alarm if an object it is tracking exits the zone other than at a gateway.

Each tracking zone has one or more cameras positioned to continuously monitor the entire floor space of the zone, including the gate(s). An "object" for visual tracking according to the invention is a cart, tub, container or vehicle that has its own associated RFID tag or carries one or more tagged items, such as mail pieces. It is not preferred to visually track individual mail pieces. Depending on the details of the RFID tracking system, each container will likely contain a number of tags, spaced from one another for readability, all of which are detected when the container passes through the gateway. In the alternative, the RFID tag could be on the container itself, and the control system maintains an association between a batch of mail of a specific range of addresses or level of sortation and that container until the container is unloaded or shipped (exits the facility).

"Video Tracking" for purposes of the invention refers to a process of using an image captured by one or more video cameras and a computer that receives the camera signal. The computer uses object recognition software to track movement of an object within the camera's field of view e.g. maintaining a map using coordinates of object positions indexed to cart ID's from the last passage through an RFID gate. The video tracking system can operate intermittently or continuously, or use motion detection sensors and capture positions when movement is detected.

The invention further provides a system for tracking position of a mail piece within a facility. Such a system includes an automated sorting machine which scans a series of mail pieces to obtain identifying indicia therefrom and sorts the series of mail pieces according to a destination-based postal sorting strategy, markers each comprising an RFID tag, containers for holding mail sorted by the sorting machine and one or more markers, carts for transporting a number of containers of mail at a time, a computerized control system associating identifiers for each RFID marker with a sequence of mail pieces in the container, an RFID gateway which scans RFID tags present on a cart passing through the gateway, which gateway is connected to the control system to associate a position of the container at the time of scanning with the mail in the containers on the cart, and a video tracking system which tracks the cart from its position at the time of scanning to a later different position.

A cart according to the invention is a rolling storage device suitable for holding and transporting trays of mail, which may weigh hundreds of pounds. A sweepside 1226 cart or an USPS APC (all purpose container) are wheeled carts that can be tracked according to the method of the present invention. These and other aspects of the invention are described further in the detailed description that follows. It is to be understood that terms used in the present invention should be given their meanings recognized in the postal sorting art, if applicable, not more general definitions found in dictionaries.

BRIEF DESCRIPTION OF THE DRAWINGS

In the accompanying drawings, where like numerals denote like elements and letters denote multiples of a component.

DETAILED DESCRIPTION

Figure 1:
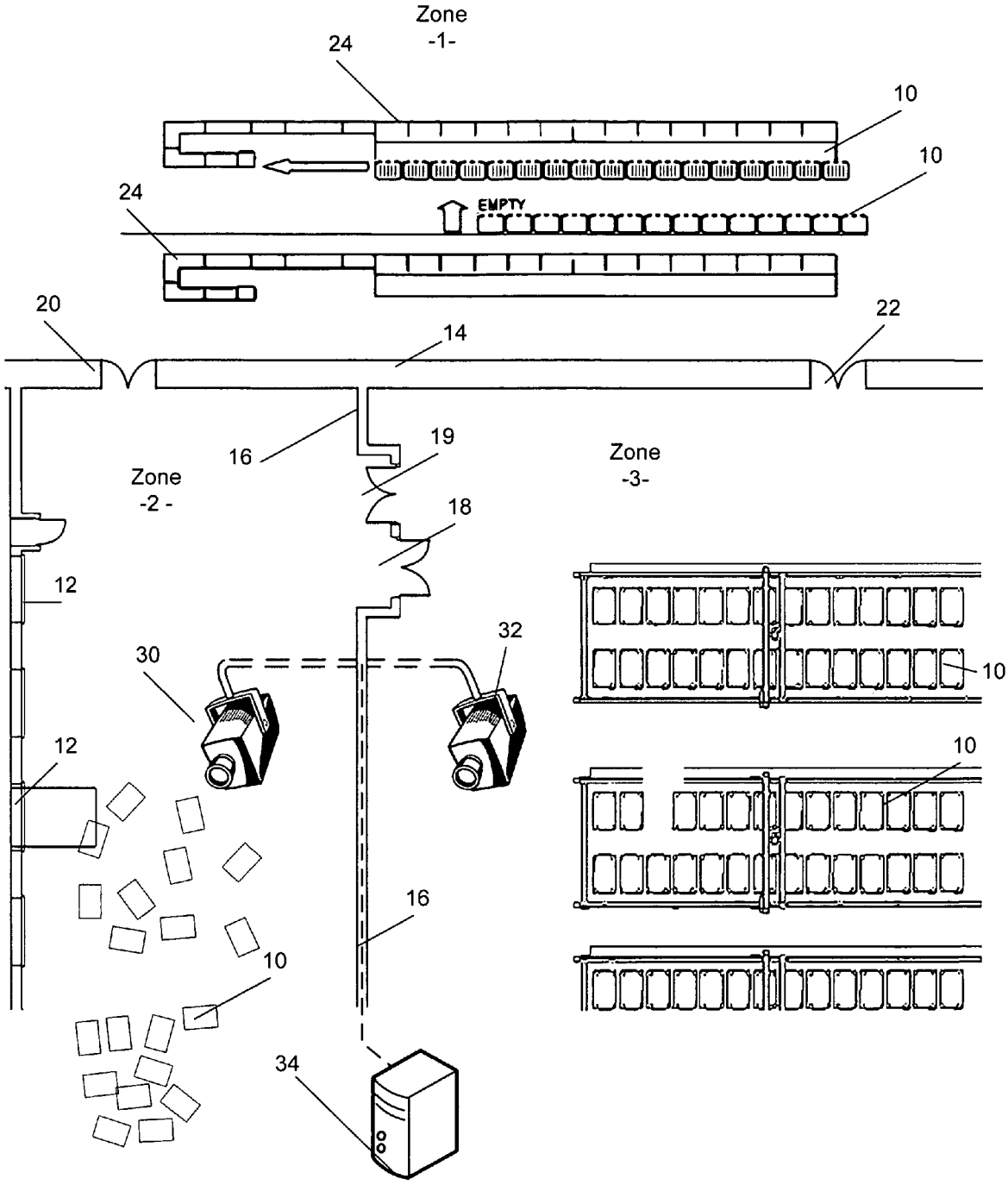
FIG. 1 is a schematic diagram of a postal facility such as a GPMC equipped to carry out a method according to the invention.

Referring to FIG. 1, in a postal facility according to the invention, an tracking system is in place wherein RFID tags are being used to track mail pieces and/or mail transport carts or vehicles 10, and visual tracking is used to track cart positions as they are transported through predefined zones.

In the example of FIG. 1, zone 1 is an area wherein DBCS sorting machines operate. Zone 2 is a loading zone adjacent a series of loading docks 12. Zone 3 is an optional holding area in which loaded carts 10 are parked for storage and later retrieval. Zone 1 is separated from zones 2 and 3 by a partition wall, fence or barrier 14. Similarly, a wall, fence or barrier 16 separates zones 2 and 3. Wall 16 has an RFID gate 18 that reads the tags on carts 10 moving from zone 3 to zone 2. An optional exit gate 19 not equipped for RFID detection may be provided for return of empty carts. Wall 14 is shown with a pair of RFID gates 20 and 22, which lead to zones 2 and 3 respectively.

The foregoing layout can function in two modes. If it is desired to load carts 10 containing mail sorted on a DBCS machine 24 directly into trucks, then the cart is RFID scanned through gate 20. A video tracking camera 30 in zone 2 tracks the position of each cart 10 moved into the loading dock area. A visual projection system such as disclosed in U.S. Ser. No. 12/266,779, cited above, can be used to instruct dock workers which dock/truck to load the cart into, or a less elaborate video screen could be used for a similar purpose. For example the display (lists cart #1017 to dock #5, and the control computer 34 removes from the display carts that have already been loaded and adds new ones arriving through the RFID gateway. If it appears on the video tracking system comprising computer 34 and cameras 30 (and 32) that a cart 10 has moved to the wrong dock, then an alarm (audible, red light or both) is given to alert the operator of the error and seek to correct it. As long as a cart 10 has not disappeared from the field of view of the camera(s) 30 in zone 2, then it can continue to be tracked it as a correction is attempted. Otherwise it may be necessary to reset the tracking process by taking the cart 10 back through an RFID gateway so that it can be re-scanned and tracked from that point to the dock assigned for those RFID tags.

In a second example, it is needed to store a number of carts 10 (such as more than can fit in the loading zone 2 at the same time) in the holding area of zone 3. Carts 10 pass through RFID gate 22 and enter zone 3, at which point they are video tracked by one or more cameras 32. The system saves the stored locations until movement occurs. At loading time carts 10 are removed one at a time and pass through RFID gateway 18. Thereafter the video tracking system uses camera 30 to track each cart 10 until the time of loading as in the previous example. The number of intermediate zones between the sorting area (zone 1) and the facility exit (zone 2) depends on the layout of the facility and any other operations that are needed. There may also be a correction zone wherein carts go when mail errors need to be corrected, which zone would have entry and exit gates or a single gate programmed to perform both functions. Such a zone might not require any video tracking function, especially if manual changes are being made to cart contents.

Figure 2:
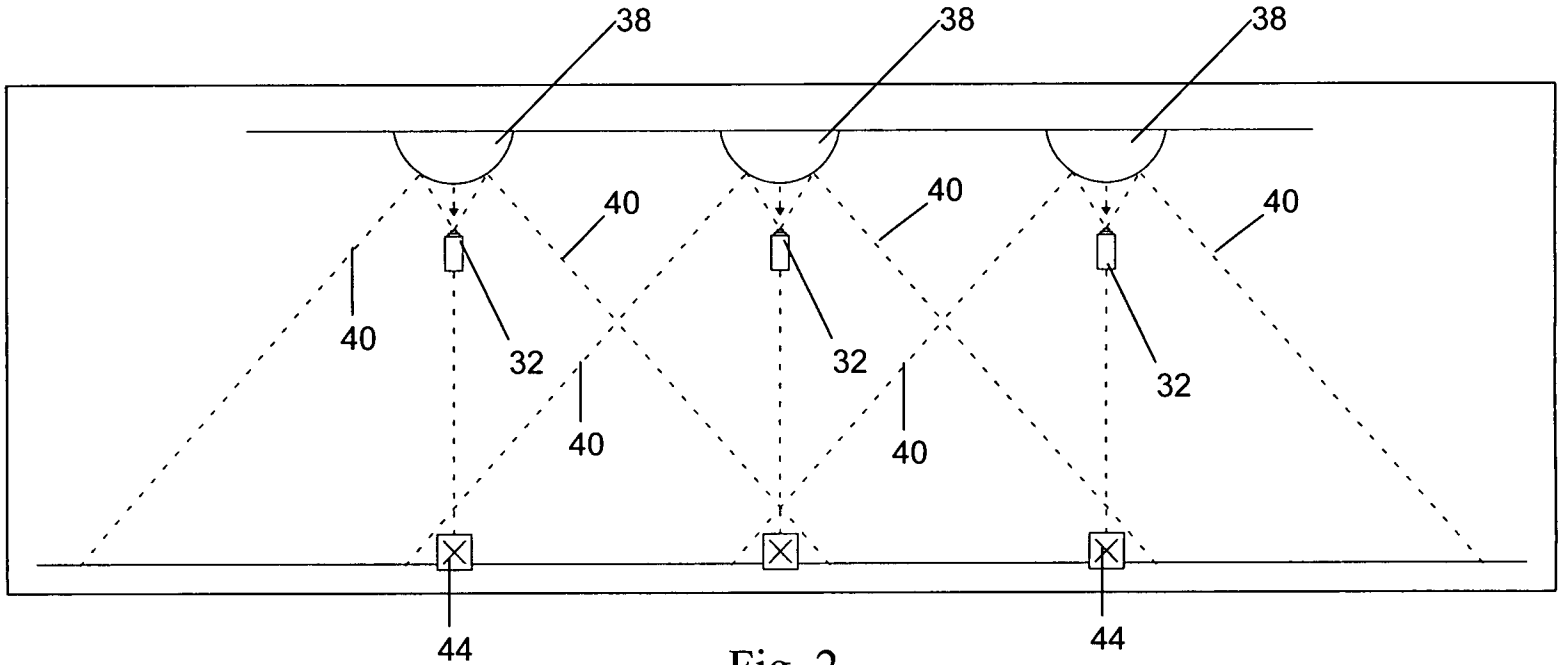
FIG. 2 is a side view of a camera installation useful for video tracking according to the invention.
Figure 3:
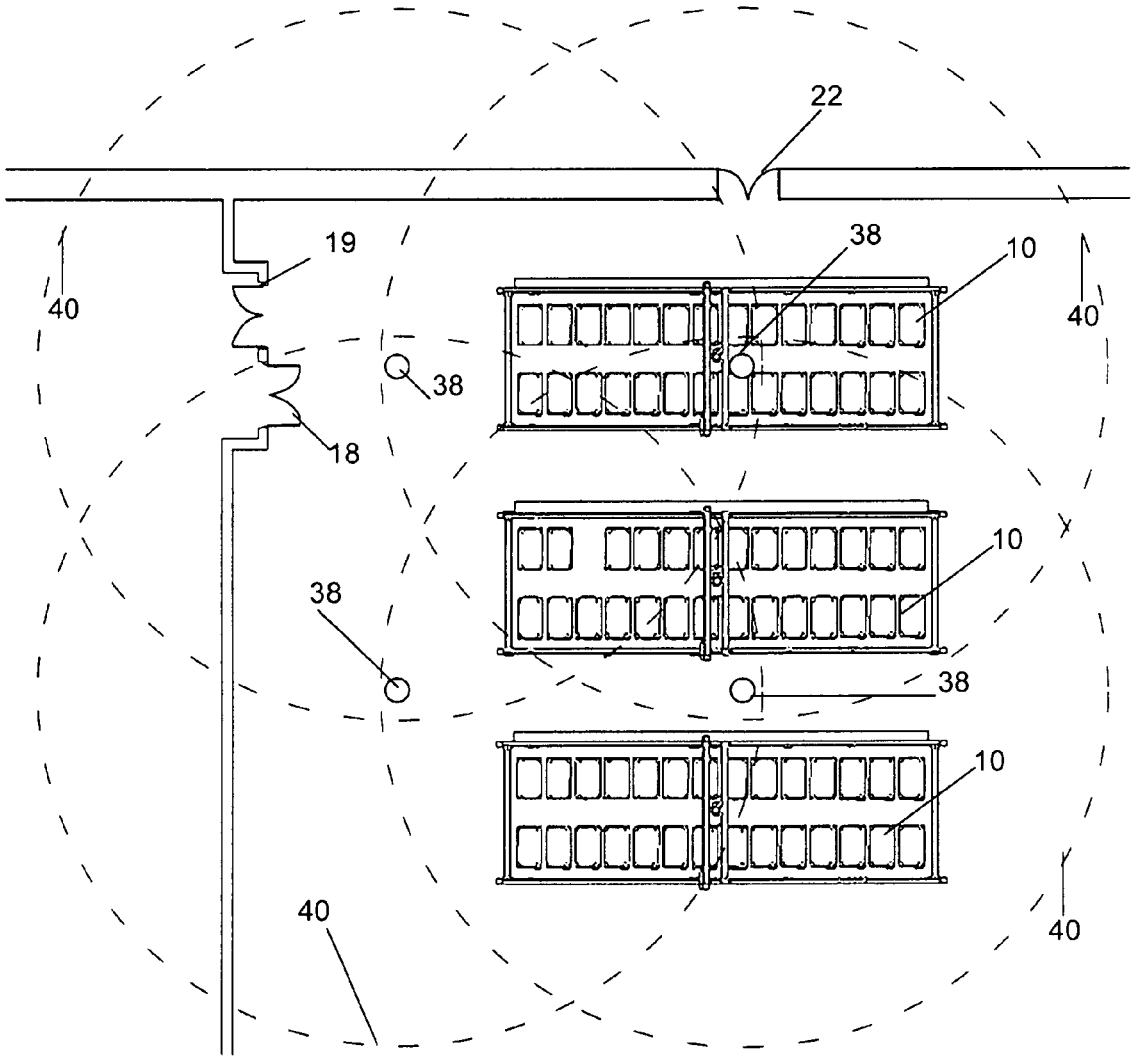
FIG. 3 is a schematic overhead view of fields of vision in zones according to the invention using the cameras of FIG. 2.

In large areas such as zone 3 is likely to be, a single camera is likely to be insufficient to monitor positions of all carts 10 in the area. For this purpose control computer 34 relies on signals from a set of cameras 32 deployed in spaced positions with overlapping fields of view. To better visualize the entire area, cameras 32 may be of a type shown in FIG. 2. Each camera 32 is positioned to look upwardly at a dome shaped (convex) reflector 38 shaped to receive an image for a circular area of floor comprising its cone shaped field of view 40. As shown in FIG. 3, cameras 32 are arranged given the size of the area to be covered so that the fields of view 40 overlap as shown and all adjacent gateways are covered. Dead zones 44 directly underneath a camera 32 are covered by on or more adjacent cameras 32. The video tracking software correlates the images and maintains a map using x, y coordinates of the position of each cart 10 within the zone. In a larger facility several such multi-camera zones could adjoin one another, with RFID gateways between them, to track cart movements over the entire facility. Workers are instructed not to take actions that might interfere with video tracking, for example, overlaying another object on a cart that might change its outline as originally recorded by the camera(s). Even if such an error occurs, the cart can be rechecked by moving it to an RFID gateway.

In a system according to the invention, RFID detection gateways are provided at strategic locations, and when one or more tags pass through, the event is logged by a control system computer which is most likely the same computer 34 operating the vision system, but multiple computers networked to share data could also be employed. Thus for any given tag, it is known which RFID gate it last passed through. However the actual location of a cart 10 is known only by means of the video tracking system. This feature facilitates locating a cart which is in the wrong area or which needs manual intervention to change an error in its contents.

To provide an RFID system which does a reasonable job of tracking the physical location of each item would require a large number of gateways or similar detectors, which are expensive and take up space. Hence the present invention uses both a limited number of RFID gateways in combination with cameras to monitor movement of mail within a facility. Even an individual letter could be located by combining information from the RFID system and the video tracking system. For example, using the mail tracking method of the foregoing Redford patent application, it is known following sorting which two RFID tags a mail piece is located between, even if those tags are on cards in different trays. Thus an individual mail piece or group of mail pieces stored in a tray on a cart somewhere in the facility can be located without an exhaustive manual search.

The video tracking system uses object recognition software similar to that used in parcel doubles detection systems recognizes the outline of the graphical object and associates the detected RFID tags with that object's shape and position. It maintains a map in computer memory of the position of the tracked object within the zone and continues to track it as it is moved within the zone. It tracks the object based on its shape and movement history. There is no need to read a bar code or other marking. When a cart leaves the zone through a gateway, the identity will be confirmed by checking the RFID tags, and if the detected tags are less than what the control system expected or includes additional tags that are unexpected, then an alarm or alert is given. The error may be no more than a misread of a tag as a cart is passing through a gate, and thus once this is confirmed no further action is needed.

The graphical map of a zone can be displayed to a human operator overwritten with labels identifying each object or highlighting objects containing RFID tags of interest. If it is desired to find a specific cart that might contain incorrect mail, for example, it can be located within the zone using the map, and it is not necessary for it to pass through a gateway to be identified, nor is it necessary for a worker with a hand held detector to manually search for the item.

Once the cart or the like passes out of the zone into an adjacent zone, it is dropped from the map of the zone it is departing and added to the map of the zone it is entering. In this manner the current position of all objects can be tracked, but with occasional confirmation when specific RFID tags pass through a gateway. Since video cameras can be positioned to cover a relatively large area, the system greatly reduces the total number of gateways needed, while providing continuously updated location information for all the items being tracked by the system. On the other hand, the use of the gateways at strategic points maintains the association between a tracked object and its RFID codes, and ensures that a visual tracking error that may occur within a zone is corrected.

In a system meant to track movement of batches of mail within a postal facility, the association between a container and its contents is temporary and it is not necessary to RFID tag each cart. The hybrid system described here has advantages over both a purely RFID based system and a purely visually based system. The pure RFID system is either too expensive (requiring too many gateways) or can't be used to physically locate an item if the number of gateways is kept reasonable. A purely visual tracking system is susceptible to errors if it loses sight of an item, and may require a readable tag or label on each item tracked.

As discussed in Redford '749, each RFID tag is a card slightly larger than a typical letter or other mail piece in a tray and pre-programmed with a tag value and serial number. A database maintained by the control computer correlates RFID tag data with an Intelligent Mail Barcode ( IMB ) on the marker. Each RFID Tag Marker (RTM) is 6 inches tall with a bright colored band along the upper margin and a very visible printed serial number. The RTM's are reusable.

According to a method of the present invention, each marker is inserted into the mail during sorting, and the system can identify the marker by reading the IMB. At least one RTM per pocket/tray is used, and the mail sequence record between tags is maintained by the control computer. RIM insertion at the feeder can be manual or automatic. In a manual system, an operator adds an RTM every time a tray is loaded.

The system can alert the operator if insufficient RTM's have been inserted. An automatic system would introduce RTMs into the mail stream as needed. An RFID gateway is placed such that mail exiting a sort operation passes through the gateway. Preferably the system is capable of grouping the tags on a cart (maintaining lists of tags are found on each cart) and determining if the grouping is correct when a cart passes through a gateway. For example, an RTM associated with outbound mail should not be seen on a cart with inbound RTM's. "Outbound" in this context mail to be shipped to another regional processing center, as opposed to mail to be shipped to a delivery unit.

As noted above the control computer is programmed to generate an alarm when the vision and/or RFID system detect an error. Alarms can be local and or remote and responsive to events including mis-routing of a cart, mis-processing of mail pieces, and missing mail. Simple red/green light indicators provide feedback on the production floor. A high level schematic of the plant could display volumes and last seen points for a cart which needs to be located. An operational view could show mail processed, in queue and in work for each operation. In the event of an error, having both visual tracking and RFID data showing the last gateway the item passed through provide confirmation that the vision system is operating accurately and allow the vision system to reset each time a cart passes through a gateway.

Although several embodiments of the present invention have been described in the foregoing detailed description and illustrated in the accompanying drawings, it will be understood by those skilled in the art that the invention is not limited to the embodiments disclosed but is capable of numerous rearrangements, substitutions and modifications without departing from the spirit of the invention. Such modifications are within the scope of the invention as expressed in the appended claims.

The invention claimed is:

1. A method for tracking position of a mail piece within a facility, comprising:

scanning a series of mail pieces to obtain identifying indicia therefrom;

sorting the series of mail pieces according to a destination-based postal sorting strategy;

placing the sorted mail pieces into a container, the container having a separate marker comprising an RFID tag and a barcode which is correlated to the RFID tag, the marker not attached to or containing the mail pieces;

in a computerized control system, associating identifiers for the marker with a sequence of mail pieces in the container;

scanning the RFID tag of the marker to associate a position of the container at the time of scanning with the mail in the container;

transporting the container; and video tracking the container from the position at the time of scanning to a later different position, including maintaining a map of each position of the container within the facility.

2. The method of claim 1, wherein the containers are postal trays, and the transporting step further comprises placing set of trays on a cart, and then moving the cart in order to transport the set of trays, whereon the scanning step is executed for all markers in the set of trays.

3. The method of claim 2, wherein the scanning step further comprises moving the cart through an RFID tag detecting gateway, and the video tracking step further comprises starting tracking of a cart as it leaves the gateway, and using a control computer, associating the mail pieces identified by the markers detected as the cart moves through the gateway with the position of the cart tracked by the video tracking system.

4. The method of claim 2, wherein an interior space of the postal facility is divided into two or more zones each having a video tracking system and an RFID gateway at an entry location for that zone, further comprising video tracking each cart as it moves within a zone;

scanning RFID tags on each cart as it passes through a gateway from one zone to another; and using the results of each scan to initiate video tracking as a cart leaves one zone and enters another.

5. A computer-implemented process of tracking mail during postal handling at a postal processing facility, comprising:

initially sorting an incoming stream of mail on an automated sorting machine to a series of pockets based on a sort scheme;

during sorting, introducing separate RFID-tagged, machine-sortable markers into the incoming mail stream at intervals and sorting the RFID-tagged markers with the mail into pockets of the sorter, the markers not attached to or containing individual mail pieces, wherein the RFID tagged markers are identified during sorting by reading a barcode on the marker;

sweeping the mail and RFID-tagged markers from the pockets into trays, wherein the markers are introduced such that at least one marker is swept to each of a set of trays containing the sorted mail;

transporting the trays containing the mail and RFID-tagged markers from the automated sorting machine;

during a postal operation subsequent to the initial sorting, scanning one or more of the RFID-tagged markers; and identifying mail from the initial sorting from the scanned RFID-tagged markers; and tracking the position of each tray during the transporting step using a video tracking system.

6. The method of claim 5, wherein the transporting step further comprises placing the set of trays on a cart, and then moving the cart in order to transport the set of trays, whereon the scanning step is executed for all markers in the set of trays.

7. The method of claim 6, wherein the scanning step further comprises moving the cart through an RFID tag detecting gateway, the video tracking step further comprises starting tracking of a cart as it leaves the gateway, and using a control computer, associating the mail pieces identified by the markers detected as the cart moves through the gateway with the position of the cart tracked by the video tracking system.

8. The method of claim 7, wherein an interior space of the postal facility is divided into two or more zones each having a video tracking system and an RFID gateway at an entry location for that zone, further comprising:

video tracking each cart as it moves within a zone;

scanning the RFID tagged markers on each cart as it passes through a gateway from one zone to another; and using the results of each scan to initiate video tracking as a cart leaves one zone and enters another.

9. A system for tracking position of a mail piece within a facility, comprising:

markers each comprising an RFID tag and a barcode;

an automated sorting machine which scans a series of mail pieces to obtain identifying indicia therefrom and sorts the series of mail pieces according to a destination-based postal sorting strategy, and that also sorts the markers with the mail pieces, using the barcode to identify the markers;

containers for holding mail sorted by the sorting machine and one or more separate markers;

carts for transporting a number of containers of mail at a time;

a computerized control system associating identifiers for each RFID marker with a sequence of mail pieces in the container;

an RFID gateway which scans RFID tags present on a cart passing through the gateway, which gateway is connected to the control system to associate a position of the container at the time of scanning with the mail in the containers on the cart; and a video tracking system which tracks the cart from its position at the time of scanning to a later different position.

* * * * *